US006343487B1

(12) United States Patent
Chen

(10) Patent No.: US 6,343,487 B1
(45) Date of Patent: Feb. 5, 2002

(54) ADVANCED HEAT INTEGRATED RECTIFIER SYSTEM

(75) Inventor: David Chen, Sugar Land, TX (US)

(73) Assignee: Stone & Webster, Inc., Houston, TX (US)

( * ) Notice: Subject to any disclaimer, the term of this patent is extended or adjusted under 35 U.S.C. 154(b) by 0 days.

(21) Appl. No.: 09/792,091

(22) Filed: Feb. 22, 2001

(51) Int. Cl.[7] ..... F25J 3/02
(52) U.S. Cl. ..... 62/620
(58) Field of Search ..... 62/620, 627

(56) References Cited

U.S. PATENT DOCUMENTS

| | | | |
|---|---|---|---|
| 1,932,903 | A | 10/1933 | McKee |
| 2,214,790 | A | 9/1940 | Greenewalt |
| 2,582,068 | A | 1/1952 | Roberts |
| 3,186,182 | A | 6/1965 | Grossman et al. |
| 3,444,696 | A | 5/1969 | Geddes et al. |
| 3,555,836 | A | 1/1971 | Schramm |
| 4,002,042 | A | 1/1977 | Pryor et al. |
| 4,270,940 | A | 6/1981 | Rowles et al. |
| 4,608,068 | A | 8/1986 | Bauer et al. |
| 4,657,571 | A | 4/1987 | Gazzi |
| 4,900,347 | A | 2/1990 | McCue, Jr. et al. |
| 5,035,732 | A | 7/1991 | McCue, Jr. |
| 5,505,049 | A | 4/1996 | Coyle et al. |
| 6,023,943 | A | 2/2000 | Wang et al. |

*Primary Examiner*—William Doerrler
*Assistant Examiner*—Malik N. Drake
(74) *Attorney, Agent, or Firm*—Hedman & Costigan, P.C.

(57) ABSTRACT

This invention includes both novel processes and methods and also novel apparatus and equipment especially adapted for carrying out the processes and achieving the excellent results and outstanding advantages which are obtained thereby and which are essential and basic parts of the invention. This apparatus and process achieved thereby include, but are not limited thereto, a rectifier tower with a reflux drum and a multi-refrigerant core exchanger.

13 Claims, 1 Drawing Sheet

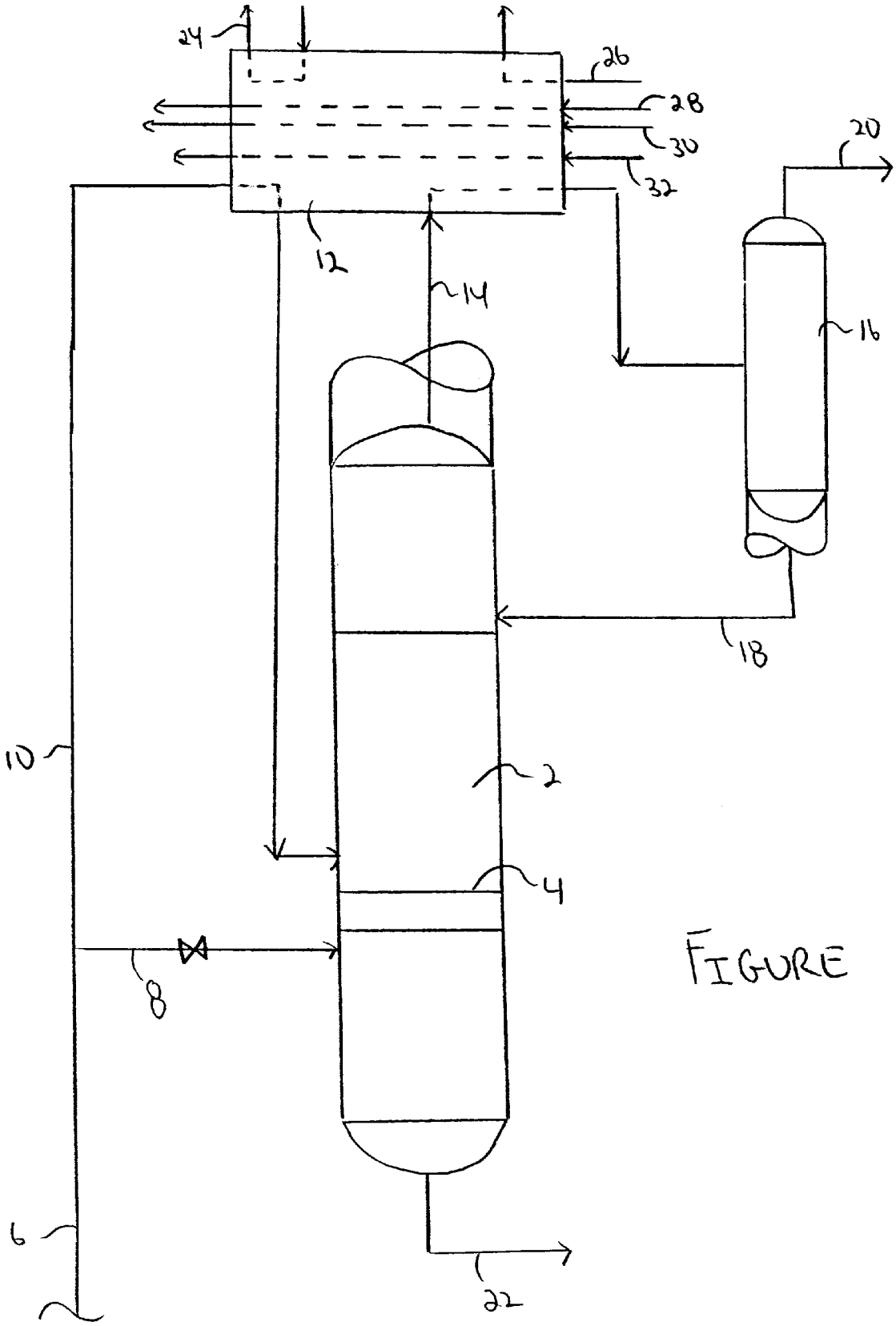
FIGURE

ADVANCED HEAT INTEGRATED RECTIFIER SYSTEM

FIELD OF INVENTION

This invention relates to and defines an interrelated and integrated rectification and fractionation system, which together comprise a novel system for achieving the desired fractionation with a minimum energy consumption level. The improved system comprises a rectifier tower having a reflux drum mounted at its top together with a multi-refrigerant core exchanger for tower feed and overhead vapor chilling.

BACKGROUND OF INVENTION

There are various and many processes and systems known for rectifier systems and more especially known systems for supplying and controlling the heat in the different areas and steps of the rectifier systems.

Among the examples of such known technology are U.S. Pat. No. 1,932,903 to McKee; U.S. Pat. No. 2,214,790 to Greenewalt; U.S. Pat. No. 2,582,068 to Roberts; U.S. Pat. No. 3,186,182 to Grossman et al; U.S. Pat. No. 3,444,696 to Geddes et al; U.S. Pat. No. 3,555,836, to Schramm; U.S. Pat. No. 4,002,042 to Pryor et al; U.S. Pat. No. 4,270,940 to Rowles et al; U.S. Pat. No. 4,608,068 to Bauer; U.S. Pat. No. 4,657,571 to Gazzi; and U.S. Pat. No. 5,505,049 to Coyle et al.

McKee, U.S. Pat. No. 1,932,903, describes a process which comprises liquefying a gas by dissolving it in a strong solution of an organic acid in which the gas is more soluble than in water. The resulting salt solution is then heated to remove the dissolved gas and the gas so recovered is dried by contacting it with liquefied gas in a dephlegmator and the resulting dried gas is then cooled.

Greenewalt, U.S. Pat. No. 2,214,790 is directed to a separation process adapted for separation of a gaseous mixture in at least a two-stage rectification, with each stage of the rectification being conducted at a different super-atmospheric pressure, using a liquid refrigerant which can be converted to the gaseous state under the conditions employed in the separation. More specifically, the process is especially for the separation of ethylene from gaseous hydrocarbon mixtures. Ammonia is the refrigerant of choice for the separation of the components in the gaseous hydrocarbon mixture.

Roberts, U.S. Pat. No. 2,582,068 describes a method and apparatus for the separation of a gaseous mixture, which is initially at a high pressure and recovering the more volatile constituent. The separation process is particularly adapted for binary gaseous mixtures and for separating and recovering the more volatile fraction in a pure or greatly purified condition.

Grossman et al., U.S. Pat. No. 3,186,182 describes a low temperature, low-pressure system and process for separation of gaseous mixtures and more particularly, for the demethanization of a gas and more particularly a cracked gaseous mixture.

Geddes et al., U.S. Pat. No. 3,444,696 is directed to an improved process for demethanization of a gaseous mixture in order to recover ethylene from a gaseous feed mixture containing substituents both more and less volatile than ethylene. This process comprises subjecting a cooled feed mixture to a fractionator having a rectifying section at the top and a reboiled stripping section below, the feed mixture containing the ethylene. The invention process is described as achieving economic improvement as respects energy consumption required by employing carefully controlled and different temperature levels in the fractionator section and in the rectifying section as well as locations of the introduction of the feedstock and heat removal by heat exchange between the feedstock and the reflux stream in the sections of the fractionator.

Schramm, U.S. Pat. No. 3,555,836 describes a process for separation of an acetylene-rich gaseous mixture and simultaneous production of acetylene, which includes a pre-cooling process carried out in a series of stages at succeedingly lower temperatures. Individual condensates each of which contains a fraction of acetylene are collected from each stage. The condensates so collected are then recombined in a rectification column, to recover the acetylene and a $C_2$ overhead fraction. This overhead is then scrubbed to remove and recover the acetylene.

Pryor et al., U.S. Pat. No. 4,002,042 describes a process for the separation and recovery of a large (major) portion of the feed gas comprising hydrogen, methane, ethylene and ethane. The feed gas is then passed to a dephlegmator for separation into a vapor stream and a condensate stream. The condensate stream is passed to a demethanizer column where it is fractionated into an overhead methane-hydrogen stream and a bottoms product ethylene-ethane stream.

Rowles et al., U.S. Pat. No. 4,270,940 describes an improved system for recovery of ethane and ethylene from demethanized overhead. The uncondensed vapor effluent from the main reflux condenser is subjected to further condensation and accompanying rectification in a dephlegmator. The liquid condensate from the dephlegmator is then returned to the demethanizer column.

Bauer et al., U.S. Pat. No. 4,608,068 describes process improvement steps adapted to the recovery of $C_3$+ hydrocarbons from a feed stream such as a refinery waste gas, having hydrogen and $C_1$ to $C_5$ hydrocarbons, which comprises the steps of cooling and at least partially condensing the feed stream, and separating the partially condensed feed stream into a liquid fraction and a gaseous fraction.

Gazzi, U.S. Pat. No. 4,657,571 describes a multi-stage process for the recovery of the heavy constituents from a high-pressure hydrocarbon gaseous mixture. The steps include cooling and partial condensation of the hydrocarbon gaseous mixture, separation of the liquid thus obtained from the gaseous mixture and feeding it to a fractionation column. A turbo-expansion is employed for the non-condensed gaseous mixture. The liquid condensed on said turbo-expansion of the gaseous mixture is separated and fed to a fractionation column. The heavy constituents are recovered from the bottom of the column. The gases from the initial fractionation step and from the second step of fractionation after turbo-expansion are then separately or together recompressed to the consignment pressure of the treated gases.

Coyle et al., U.S. Pat. No. 5,505,049 describes a process for removing nitrogen from liquefied natural gas using an enhanced surface, reflux heat exchanger. A relatively warm, high pressure liquefied natural gas is directed counter-currently in heat exchange location with a cool low pressure liquefied natural gas stream to chill the high pressure stream and at least partially vaporize the low pressure stream in a reflux heat exchanger. The vapor so produced strips the low-pressure stream of nitrogen. The cool low-pressure stream is produced by expansion of the chilled high-pressure stream. The vapor produced by this expansion is then combined with the vapor which is produced in the heat exchanger and is removed and recovered from overhead of the heat exchanger. A product of liquefied natural gas, which has low nitrogen content is recovered from the bottom of the heat exchanger.

Although many of the above-mentioned prior art processes have met with some success in industry, the energy costs in operating these systems is relatively high. Accordingly, there exists a need in the industry to develop a process which has essentially the same fractionation capability but which reduces energy costs.

SUMMARY OF THE INVENTION

According to the present invention there is provided an improved separation process and apparatus, which effect excellent fractionation at reduced energy requirements.

The apparatus of the invention is shown in detail in the accompanying Figure and described in detail herein below. The apparatus comprises a rectifier column which is equipped with fractionation trays, a reflux drum mounted on top of the rectifier tower and an elevated multi-refrigerant core heat exchanger which is used for the tower feed and for the overhead vapor chilling, and a main feed line, which branches into two feed lines, the first of which is directed to a lower portion of the rectifier tower and the second of which is directed through the multi-refrigerant core heart exchanger and then to the rectifier tower at a height above the first feed line.

With respect to the process operation of the system, improved fractionation and separation results with reduced energy requirement, can be achieved with the apparatus of the invention. The hydrocarbon feed stream to the system is initially split into two streams. The first portion of the feed stream is fed into the bottom section of the rectifier tower as stripping vapor. The second portion of the feed stream is chilled in the core heat exchanger and is then passed to the rectifier tower as the tower feed. The tower overhead vapor is also chilled in the core heat exchanger before it is introduced into the reflux drum. The resulting flashed liquid from the reflux drum is returned to the rectifier tower by gravity flow as reflux liquid.

BRIEF DESCRIPTION OF THE DRAWING

The FIGURE is a schematic diagram of the advanced heat integrated rectifier system of the invention consisting of a rectifier tower, a reflux drum mounted at the top of the rectifier tower, an elevated multi-refrigerant heat exchanger adapted for tower feed and overhead vapor chilling, and feed system.

DETAILED DESCRIPTION OF THE INVENTION

Referring to the FIGURE, the rectifier tower 2 is the base for the rectifier system. The tower 2 is equipped with fractionation trays 4 as necessary for the appropriate desired fractionation step. The main feed line 6 to the rectifier tower is divided into two feed lines. The first feed line 8 contains a minor portion of the feed, i.e. from about 5% to about 50% of the feed, more preferably 25% to about 35%. The second feed line 10 contains the remaining major portion of the total feed.

The small (minor) portion of the feed stream is passed via line 8 into a bottom portion of the rectifier tower and functions as the stripping vapor for the system.

The major portion of the feed stream is passed via line 10 to an elevated core exchanger 12 wherein it is initially chilled before it is passed to the rectifier tower 2 as feed at a height above the entry point of the first feed line 8. Additionally, the tower overhead vapor in a line 14 is also chilled in the core heat exchanger 12 before passing to the reflux drum 16 for flashing. During the period of operation, the liquid which is flashed from the tower reflux drum is returned via gravity flow through line 18 to the towel as reflux liquid. The recovered vapor is removed from the top of the reflux drum 16 through product line 20. The liquids from the tower 2 are recovered in a line 22 for further processing.

In a preferred embodiment of the present invention, the cooling duty of the core exchanger 12 is effected by more than one refrigerated type. For example, in the Figure, refrigerant passage 24 can comprise one or more ethylene refrigerant streams; refrigerant passages 26 and 28 can comprise an expanded process vapor, refrigerant passage 30 can comprise a hydrogen refrigerant, and refrigerant passage 32 can comprise a methane refrigerant.

In such an embodiment for recovery of ethylene, the main feed line 6 can be at a temperature in the range of about −30° C. to about −85° C. Refrigerant passages in exchanger 12 exit at a temperature of about 1 to 3° C. colder than the feed stream 10. The liquid leaving the bottom of the tower 2 will be at a temperature of about 3 to 10° C. colder than the feed stream 8 temperature.

The apparatus and process for which it permits use have advantages over the systems and devices which are presently known for the rectification and separation steps. One of these known devices for such fractionation separations is embraced by and included in conventional rectification systems. The novel heat integrated rectifier system of the invention is more efficient in the utilization of energy than are the known, conventional systems. In the typical conventional system, the temperature approach in the core heat exchanger is between the return temperature of the refrigerant streams and the rectifier overhead temperature.

By comparison, in the heat integrated rectifier system of the present invention, the temperature approach is between the return temperature of the refrigerant streams and the temperature of the rectifier feed temperature.

Under such flow scheme, operating in accord with the system of the invention can maximize the utilization of a warmer level refrigerant, thereby reducing the requirements for colder level refrigerant required by conventional known rectifier systems. This advantage results in substantial savings in refrigeration power.

Furthermore, the heat integrated rectifier system herein described is an improvement over the known dephlegmator systems. Both of these apparatus and processes are able to achieve and meet similar fractionation requirements. However, the herein described and claimed heat integrated rectifier system is more energy efficient because it allows the utilization of more of the available warm level duty in the process refrigerant streams.

In addition, it is an advantage that the heat integrated rectifier system of the invention is a more compact design than that of the dephlegmator. The operating principle of the dephlegmator is based on condensed liquid film runback fractionation which, for success, requires low velocities for the process gas. Thus, it is necessary that the size of the dephlegmator be larger than that of the heat integrated rectifier system of the invention process. For example, for a 700 KTA ethylene plant using the heat integrated rectifier system of the invention, the estimated plot size for the operation is 10 ft. by 20 ft. plus pipe rack area of 5 ft. by 20 ft. to support the core exchanger. If a dephlegmator system such as described in McCue et al. U.S. Pat. No. 4,900,317 were used for the same plant operation, the plot size needed would be significantly larger. Other advantages of the invention apparatus compact design include ease of moving and shipping, transportation, erection, and a lesser tendency for heat leakage due to the reduced surface area of the cold box and rectifier as compared to the dephlegmator system.

To summarize, the system of the invention provides an improved, energy efficient, and reduced capital cost method to achieve the fractionation results as compared with systems now known and currently used for light hydrocarbon fractionation in ethylene or natural gas separation plants.

What is claimed is:

1. An advanced heat integrated rectifier system which comprises in combination a rectifier tower having a series of fractionation trays, a reflux drum at the upper section of said rectifier tower, and an elevated multi-refrigerant core heat exchanger connected thereto and a feed system comprising a main feed line, a feed splitting means for splitting said main feed line into a first feed line which is directed to a lower portion of the said rectifier tower and second feed line which is directed through said core heat exchanger and then to said rectifier tower at an elevation above-said first feed line.

2. The advanced heat integrated rectifier system of claim 1 in which the rectifier tower has at least three fractionation trays.

3. The advanced heat integrated rectifier system of claim 1 in which the reflux drum is at the top of said rectifier tower.

4. The advanced heat integrated rectifier system of claim 1 in which the multi-refrigerant core heat exchanger is adapted for both chilling feed to the tower and to provide overhead vapor chilling.

5. An advanced heat integrated rectifier process system especially adapted for fractionation, separation, and recovery of low molecular weight hydrocarbon feed mixtures which comprises the steps of initially dividing the hydrocarbon feed stream into two portions, a smaller portion of the feed stream which is passed into the lower portion of a rectifier tower and a larger portion of the feed stream which is chilled in a core heat exchanger prior to its introduction into said rectifier tower as feed.

6. The rectifier process system of claim 5 in which the said smaller portion of the feed stream is introduced into the bottom of the rectifier tower and whereby it functions as stripping vapor for the system.

7. The rectifier process system of claim 5 in which the vapor stream from the upper portion of the rectifier tower is all chilled in the core heat exchanger prior to its return to the reflux system.

8. A process for separating a lighter gaseous component from a heavier gaseous component, said process comprising, (a) splitting a main feed line into a first feed line and a second feedline;

(b) directing said first feed line to a lower portion of a rectifying tower as a stripping vapor;

(c) chilling said second feed line in all overhead core heat exchanger;

(d) feeding said chilled second feed line to a portion of said rectifying tower above said first feed line for rectified;

(e) removing an overhead vapor from said tower and chilling and partially condensing said overhead vapor in said core heat exchanger and separating the partially condensed liquid from the remaining vapor;

(f) returning said partially condensed liquid to said tower as reflux;

(g) recovering said remaining vapor as a separated lighter gaseous component; and (h) recovering liquid comprising the heavier component from the tower bottom.

9. A process as defined in claim 8 wherein said lighter gaseous component comprises hydrogen and methane.

10. A process as defined in claim 8 wherein said first feed line comprises a lesser amount of the gaseous feed than said second feed line.

11. A process as defined in claim 8 wherein said first feed line is directed to a portion of said tower below the first tray.

12. A process as defined in claim 8 wherein said core heat exchanger has a colder section near the entry of the refrigeration streams and a warmer section near the rest of the refrigeration streams and the second feed line is chilled in said warmer portion of said overhead core heat exchanger.

13. A process as defined in claim 12 wherein said overhead vapor is chilled and partially condensed in said colder portion of said overhead core heat exchanger.

* * * * *